United States Patent [19]

Tseng

[11] Patent Number: 5,065,873

[45] Date of Patent: Nov. 19, 1991

[54] SHELF FRAME

[76] Inventor: Chun-Chu Tseng, No. 3, Ting-Hsi-Hsin, Lu-Man Ts'un, Chu-Chi Hsiang, Chiayi Hsien, Taiwan

[21] Appl. No.: 701,186

[22] Filed: May 16, 1991

[51] Int. Cl.[5] ..... A47F 5/00

[52] U.S. Cl. ..... 211/187; 211/182; 211/186; 108/107; 108/111

[58] Field of Search ..... 211/186, 182, 181, 187; 108/107, 111

[56] References Cited

U.S. PATENT DOCUMENTS

| | | | |
|---|---|---|---|
| 2,841,918 | 7/1958 | Sylwan | 211/182 X |
| 2,894,643 | 7/1959 | Maslow | 211/182 X |
| 2,919,816 | 1/1960 | Maslow | 211/182 X |
| 2,919,817 | 1/1960 | Maslow | 211/182 X |
| 3,208,406 | 9/1965 | Maslow | 211/182 X |
| 3,225,728 | 12/1965 | Maslow | 211/181 X |
| 3,272,376 | 3/1965 | Havlis | 211/186 X |
| 3,316,864 | 5/1967 | Maslow | 211/181 X |
| 3,411,634 | 11/1968 | Pesce | 211/186 X |
| 4,778,066 | 10/1988 | Stiernberg | 211/181 X |

*Primary Examiner*—Robert W. Gibson, Jr.
*Attorney, Agent, or Firm*—Willian Brinks Olds Hofer Gilson & Lione

[57] ABSTRACT

A shelf frame includes a first, a second, a third and a fourth leg device. Each of these leg devices includes an upper end, a lower end and a pair of elongated rods spaced apart from one another in parallel relationship and clamped by a plurality of clamping members. Each clamping member has a through-hole formed therein. A pair of connecting members, each has two ends respectively and correspondingly connecting the uppers end of the first and second leg devices to form a first inverted U-shaped frame, and the uppers ends of the third and fourth leg devices to form a second inverted U-shaped frame. The lower end of each leg device has a support on which the leg device stands. A transverse rod has two ends respectively connected to one clamping member on the first leg device and another clamping member on the second leg device. A rectangular plate has a pair of opposite sides each provided with at least one hook to engage the transverse rods.

5 Claims, 9 Drawing Sheets

SHELF FRAME

BACKGROUND OF THE INVENTION

1. FIELD OF INVENTION

The invention relates to a shelf frame, more particularly to the construction of a shelf frame which is more convenient to use than the conventional shelf frames.

2. DESCRIPTION OF THE RELATED ART

FIG. 1 shows a conventional shelf frame. As illustrated, the shelf frame includes a pair of rails 10 spaced apart from one another in a parallel relationship and fixedly mounted on a wall, and a rectangular plate 20 is disposed on the rails 10 and on which things can be placed for exhibition.

FIG. 2 shows another type of conventional shelf frame. Accordingly, it includes a pair of rails 10 having a plurality of holes, fixedly mounted on a wall. A plate 20 is provided on a pair of studs inserted in these holes. The plate 20 of such shelf frame can be lowered or raised when desired, and therefore is more useful than the above type.

But these conventional shelf frames still have some drawbacks. To use them, there must always be a mounting wall, since they can not stand individually. When not in use, they are not easy to store. Since nails are needed to mount a conventional shelf frame on a wall, at least some damage is done to the wall surface by mounting it on the wall.

SUMMARY OF THE INVENTION

Therefore, a main object of the present invention is to provide a shelf frame which is more convenient to use than those conventional shelf frames.

Another object is to provide a shelf frame which can exist individually without depending on other things, such as a wall.

Still another object of the present invention is to provide a shelf frame which can be easily disassembled and stored when not in use.

One feature of the present invention is that this shelf frame is more suitable to use in a large exhibition hall, since it has moving means attached to its base portion, so that the shelf frame can be moved to a desired place in order to meet the requirements of the exhibition.

Accordingly, a shelf frame of the present invention includes a first, a second, a third, a fourth leg means and a pair of reinforcing rods. Each of the leg means has an upper end and a lower end and includes a pair of elongated rods spaced apart from one another in a parallel relationship. A plurality of clamping members are provided to clamp the elongated rods of the first, the second, the third and the fourth leg means. Each of the clamping members has a groove therein. A pair of connecting members join the upper ends of the first and second leg means to form a first inverted U-shaped frame, and the upper ends of the third and fourth leg means to form a second inverted U-shaped frame. Each of the reinforcing rods connects a point on the lower portion of the first inverted U-shaped frame to a point on the upper portion of the second U-shaped frame, forming a cross between the first and second U-shaped frames. A wheel is attached to each of the leg means so that the whole assembly can be moved to a desired place when circumstances demand.

BRIEF DESCRIPTION OF THE DRAWINGS

Other features and advantages of the present invention will become more apparent in the following detailed description, including drawings, all of which show a non-limiting form of the invention, and of which.

DETAILED DESCRIPTION OF THE PREFERRED EMBODIMENT

Figure 2:
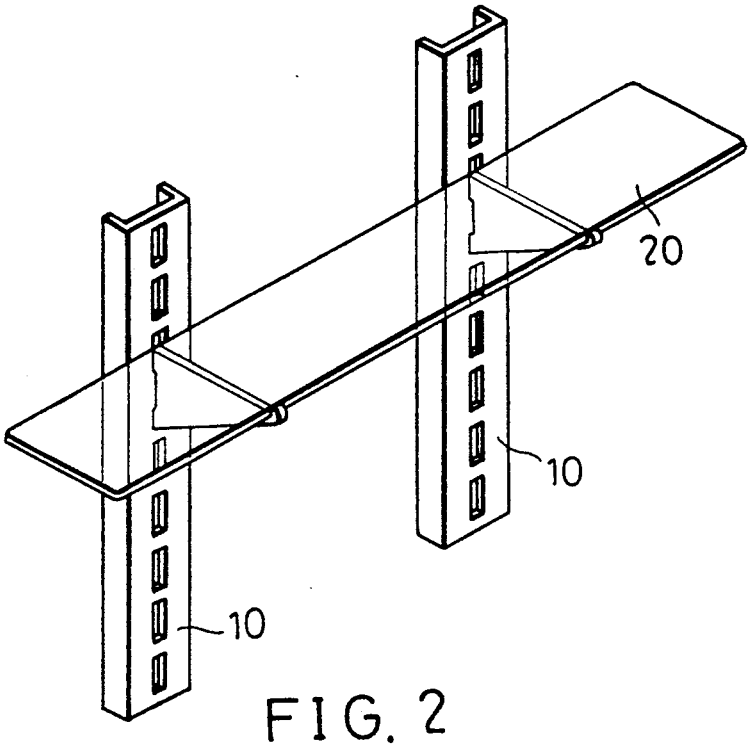
FIG. 2 (PRIOR ART)
FIGS. 1 and 2 show two kinds of conventional shelf frames of the prior art.
Figure 1:
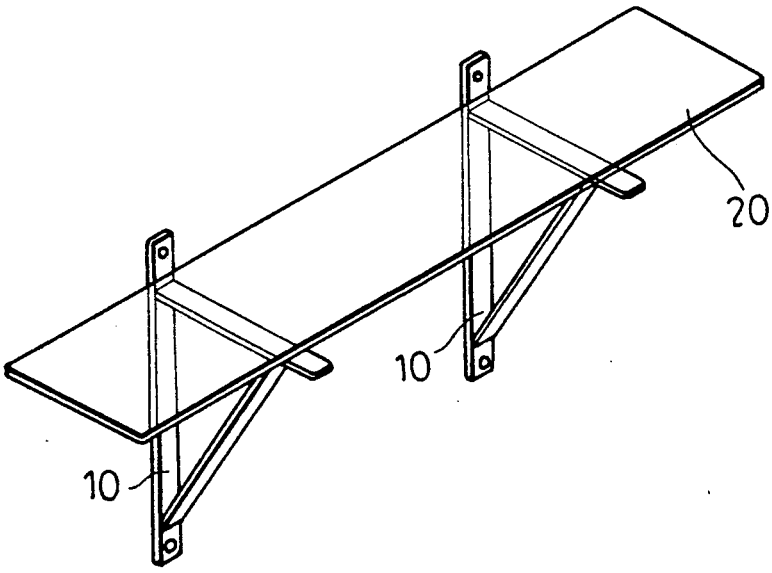
FIG. 1 (PRIOR ART)
Figure 3:
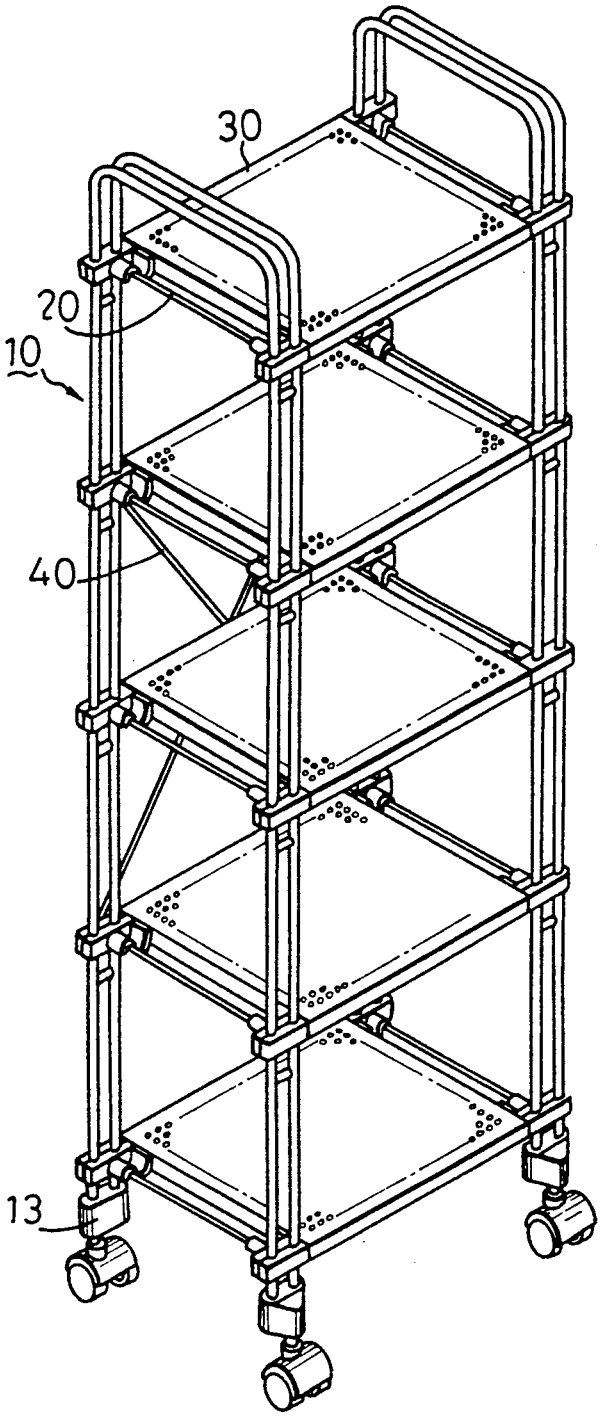
FIG. 3 is perspective, schematic view of a shelf frame of the present invention.
Figure 4:
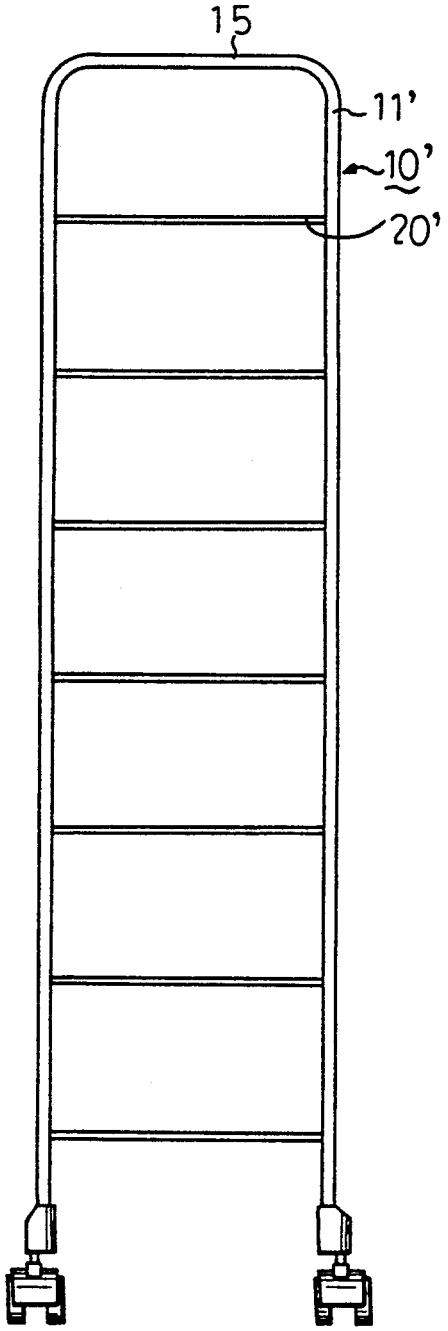
FIG. 4 is a side view of a shelf frame of the present invention, shown without clamping members attached thereto.
Figure 5:
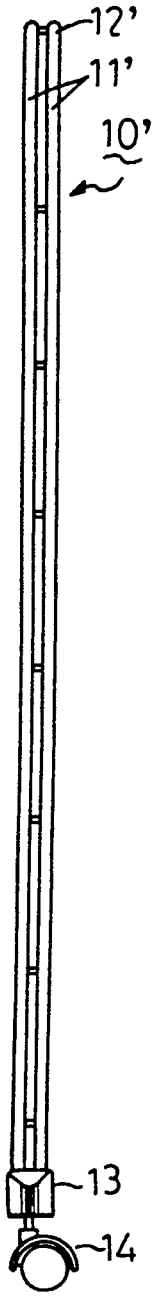
FIG. 5 is a detailed view of a leg means of the shelf frame of the present invention.
Figure 6:
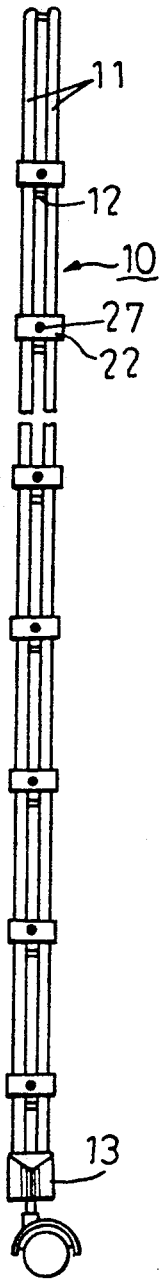
FIG. 6 shows the leg means of FIG. 5 being clamped by a plurality of clamping members.
Figure 7:
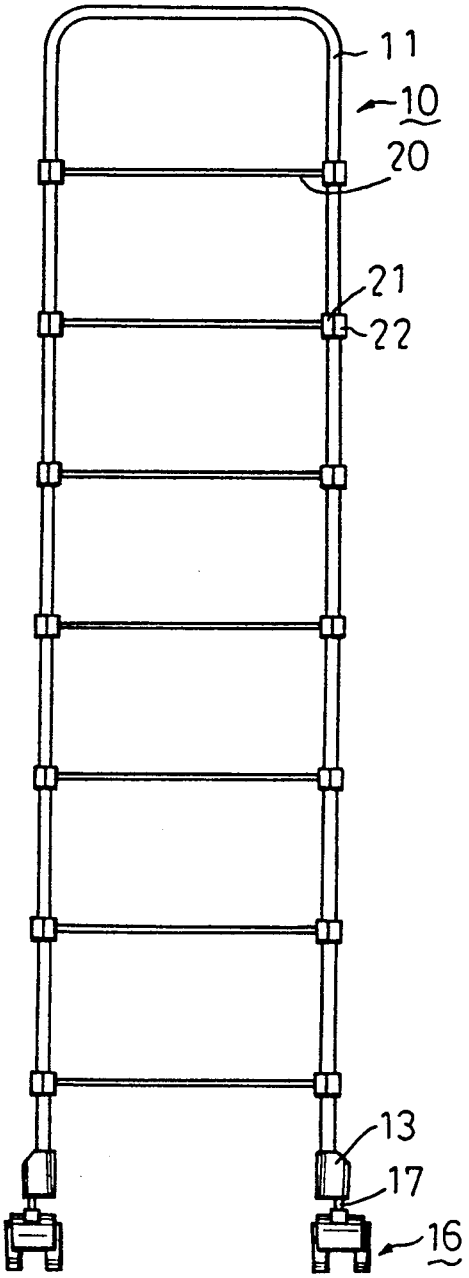
FIG. 7 shows a side view of the shelf frame of the present invention, with clamping members attached thereto.

Referring to FIGS. 3, 4 and 5, a shelf frame of the present invention is shown to comprise a first, a second, a third and a fourth leg means and a pair of reinforcing rods.

Each of the leg means 11 includes a lower end 13 connected to a support, which in this embodiment is a roller assembly 14, and will be described in detail in the succeeding paragraph, an upper end 12 and a pair of elongated rods spaced apart from one another in a parallel relationship and welded together, as shown in FIG. 5.

Figure 8:
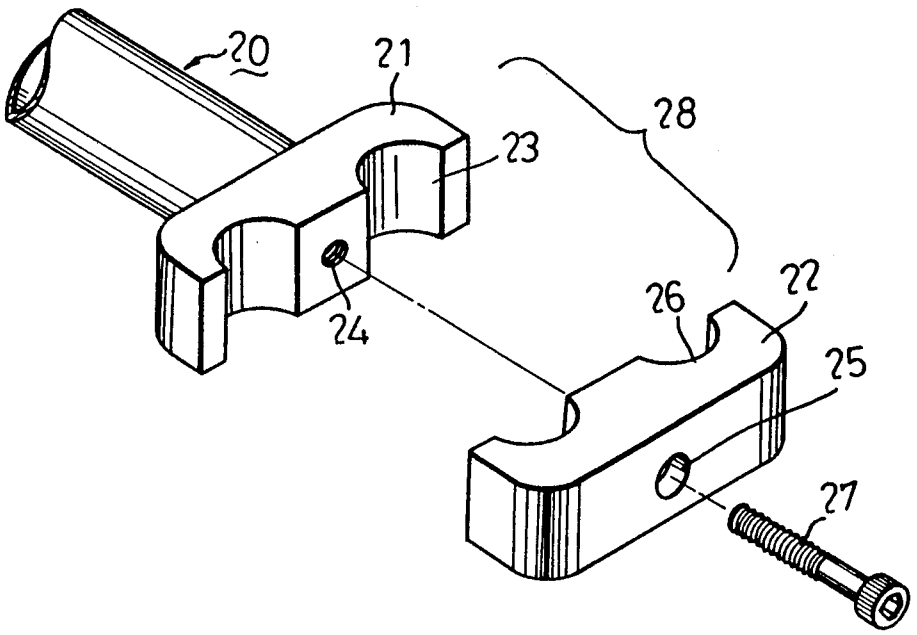
FIG. 8 is an exploded view of a clamping member used to clamped the leg means of FIG. 5.
Figure 9:
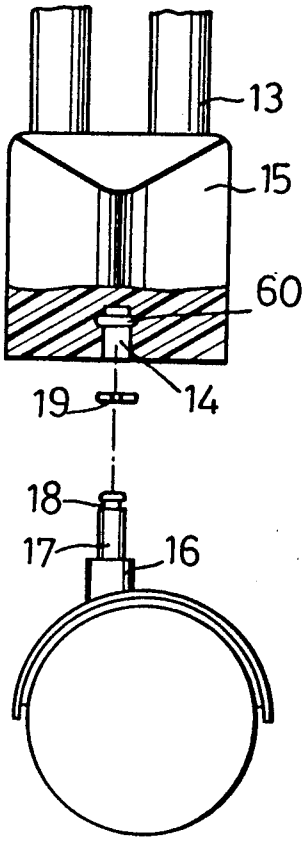
FIG. 9 is a detailed view of a moving means attached to the lower end of the leg means of FIG. 5.

Each of the leg means 11 is clamped by a plurality of clamping members 28. Each clamping member 25 includes two clamping pieces 21,22 with aligned grooves 23,26 which confine a passage for holding elongated rods when assembled and secured together by means of a screw 27. Each of the clamping members 28 has a through-hole 25,24 therein, for allowing the screw 27 to be inserted, as illustrated in FIG. 8.

A pair of connecting members 15 interconnects the upper ends 12 of the first and second leg means to form the third and fourth leg means to form a second inverted U-shaped frame. Each of a pair of reinforcing rods 40 has a first end 41 attached to a clamping member 28 at a point on the lower portion of the first inverted U-shaped frame, and a second end 42 attached to another clamping member 28 at a point on the upper portion of the second inverted U-shaped frame. The connecting members 15 are respectively secured thereat by screw means to form a cross between two inverted U-shaped frames.

A plurality of transverse rods 20 interconnect the clamping members on the first leg means with the clamping members on the second leg means. Similarly, more transverse rods 20 connect the clamping members on the third leg means with the clamping members on the fourth leg means. Each of the transverse rod 20 has two ends respectively and integrally formed with the clamping piece 21 of the clamping member 28, as shown in FIG. 8. Thus arranged, the shelf frame of the present invention will be strong enough to support a considerable amount of weight.

The lower end 13 of the leg means has a base 15 in which an axial groove 14 and a radial groove 60 are formed. A roller assembly 16 includes a stem 17 with an annular recess 18 at the tip thereof. A radially expandable ring 19 is sleeved in the annular recess 18 into the axial groove 14 where upon the radially expandable ring 19 expands to engage in the radial groove 20. Thus, the shelf frame of the present invention can be moved to a desired place when circumstances require.

Figure 11:
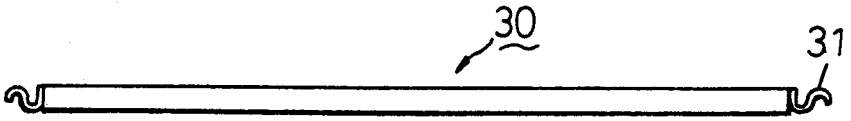
FIG. 11 is a side view of a plate disposed between a pair of leg means of the shelf frame of the present invention.
Figure 12:
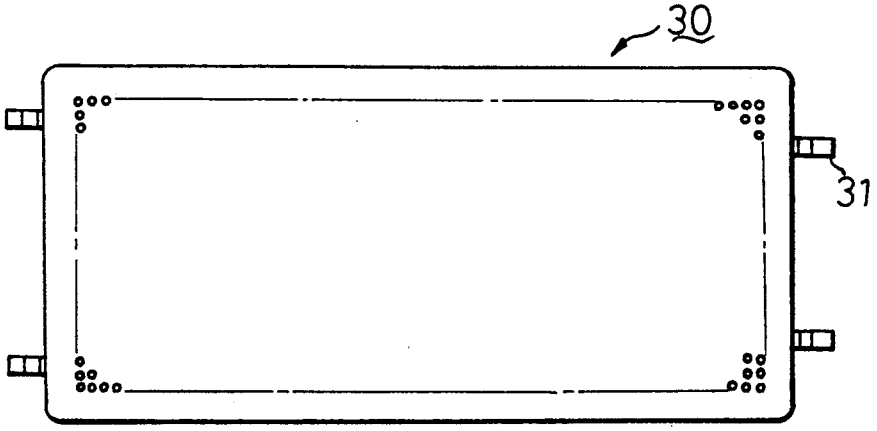
FIG. 12 is a top view of the plate of FIG. 11.
Figure 13:
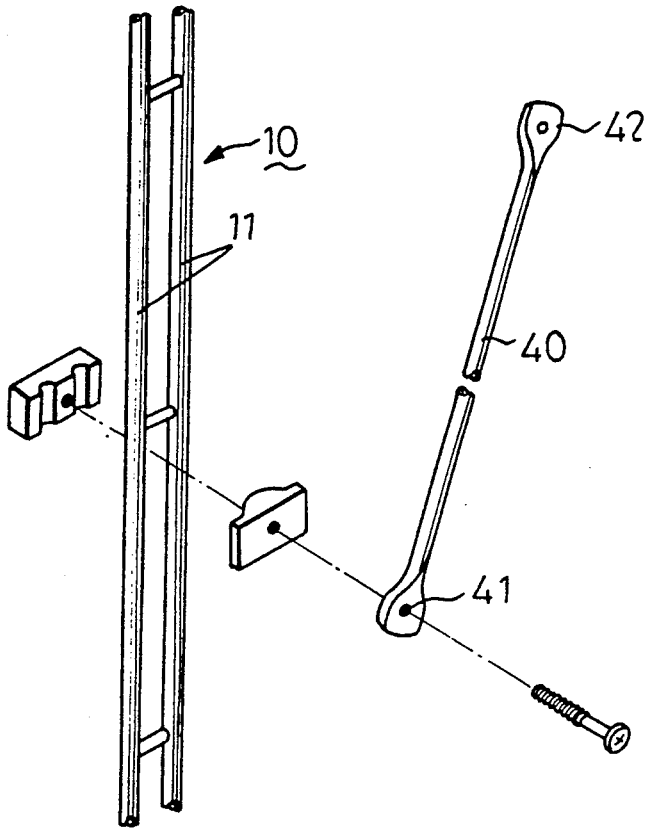
FIG. 13 illustrates how the shelf frame of the present invention is strengthen by a reinforcing rod.
Figure 14:
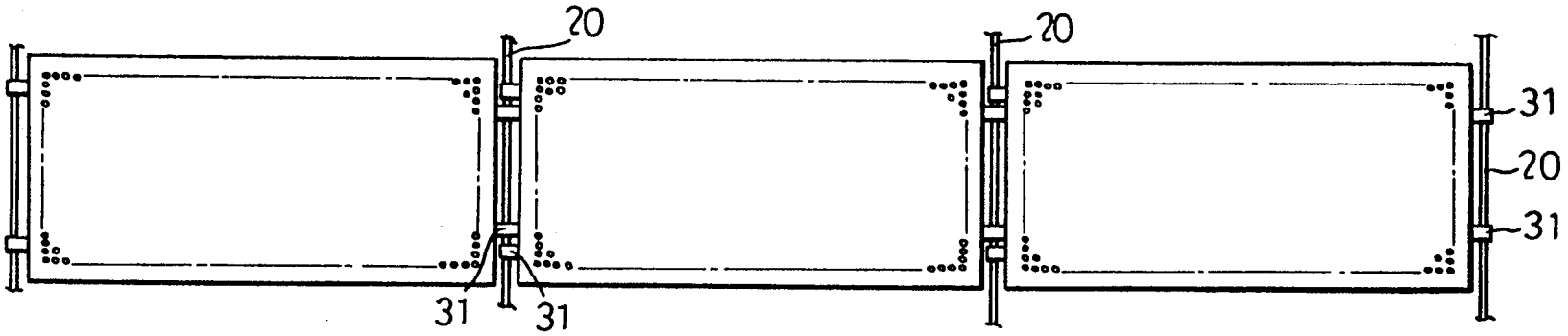
FIG. 14 is a top view of the plates of FIG. 11 disposed between a shelf frame of the present invention.

Referring to FIGS. 11 and 12, each of a plurality of rectangular plates 30 has two opposite sides, each side being provided with at least one hook 31, engages one of the transverse rods 20, as shown in FIG. 3. Alternatively, there can be a pair of hooks 31 on each side so the hooks 31 can be arranged to engage one of the transverse rods 20 as shown in FIG. 14.

Figure 10:
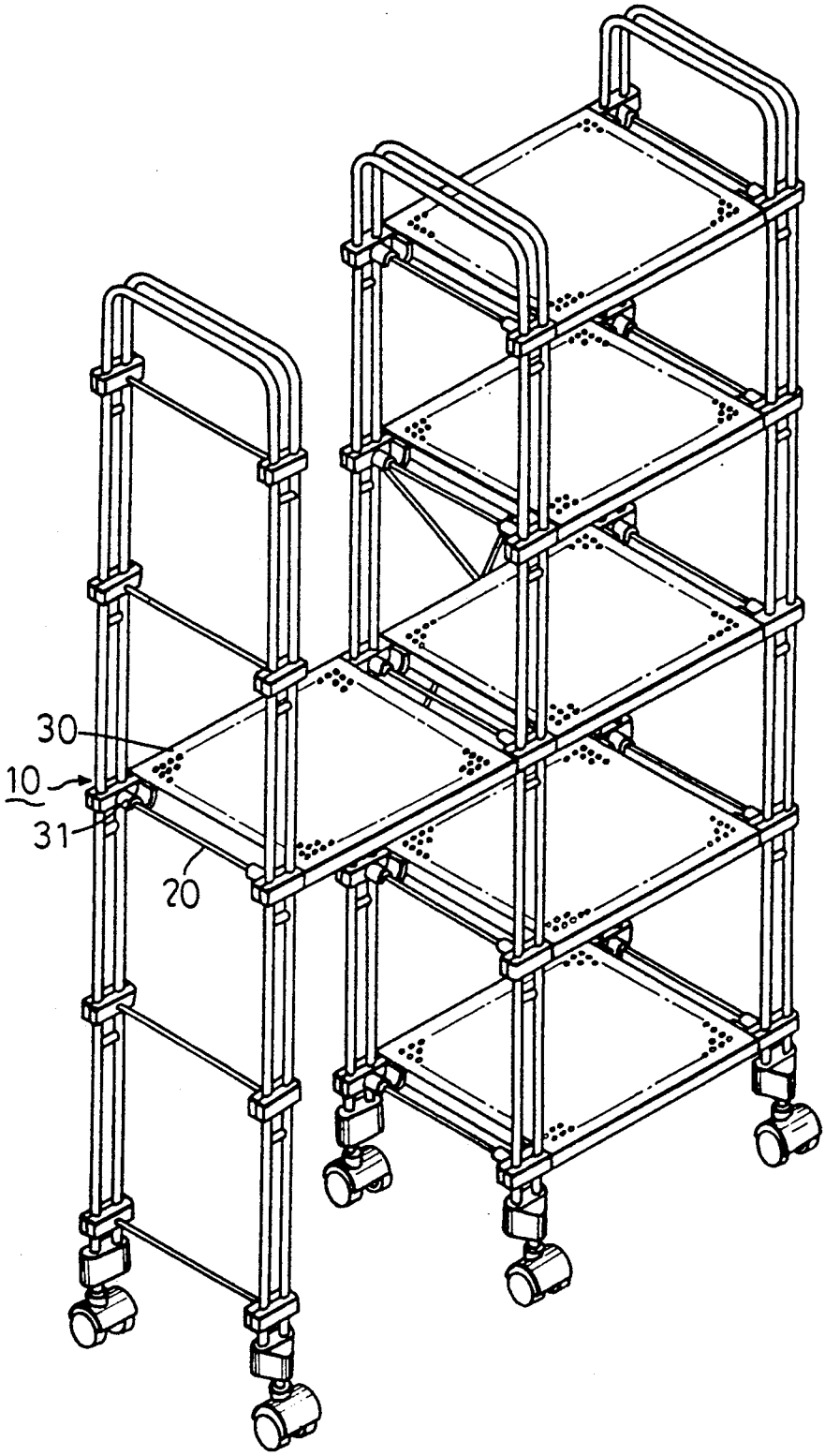
FIG. 10 is another form of the shelf frame according to the present invention.

FIG. 10 shows another form of shelf frame constructed in the above described manner.

With the invention thus explained it is obvious to those skilled in the art that various modifications and variations can be made without departing from the scope and spirit of the present invention. It is therefore intended that this invention be limited only as in the appended claims.

I CLAIM:

1. A shelf frame comprising:

a first, a second, a third and a fourth leg means, each of said leg means having an upper and a lower end, and each including a pair of elongated rods spaced apart from one another in a parallel relationship;

clamping members to clamp said pair of elongated rods of each of said first, said second, said third, and said fourth leg means;

transverse connecting rods to interconnect one of said clamping members on said first leg means with another one of said clamping members on said second leg means, and to interconnect one of said clamping members on said third leg means with another one of said clamping members on said fourth leg means; and at least one rectangular plate having two opposite sides each being provided with at least one hook engaging one of said transverse connecting rods.

2. A shelf frame as claimed in claim 1, wherein said lower end of each of said leg means has a support means attached thereto.

3. A shelf frame as claimed in claim 1, wherein each of said clamping members includes two clamping pieces, each being provided with a pair of grooves correspondingly and respectively aligned with another pair of said grooves in another said clamping piece.

4. A shelf frame as claimed in claim 3, wherein said transverse connecting rods, each has a first end integrally formed with one clamping piece of said clamping member, and a second end integrally formed with another clamping piece of another said clamping member.

5. A shelf frame as claimed in claim 1, wherein said shelf frame further comprises a pair of connecting members, one of which interconnects said upper ends of said first and second leg means to form a first inverted U-shaped frame, the other one of which said third and fourth leg means to form a second inverted U-shaped frame, and a pair of reinforcing rods, each of said reinforcing rods having one end connected to a lower point on said first U-shaped frame and the other end of said reinforcing rod connected to an upper point on said second U-shaped frame, forming a cross between said first and second U-shaped frames.

* * * * *

UNITED STATES PATENT AND TRADEMARK OFFICE

CERTIFICATE OF CORRECTION

PATENT NO. : 5,065,873

DATED : November 19, 1991

INVENTOR(S) : Chun-Chu Tseng

It is certified that error appears in the above-identified patent and that said Letters Patent is hereby corrected as shown below:

In column 2, line 60, after "form" please insert --a first inverted U-shaped frame, and the upper ends 12 of--.

In column 3, line 18, after "18" please insert --of the stem 17. The roller assembly 16 is inserted--.

In claim 5, line 33, after "which" please insert --connecting members interconnects said upper ends of--.

Signed and Sealed this

Twenty-seventh Day of April, 1993

*Attest:*

MICHAEL K. KIRK

*Attesting Officer*

*Acting Commissioner of Patents and Trademarks*